United States Patent [19]

Lawhon

[11] 4,272,063

[45] Jun. 9, 1981

[54] BRICK ASSEMBLY FOR USE IN METALLURGICAL VESSELS

[75] Inventor: Clyde E. Lawhon, Birmingham, Ala.

[73] Assignee: Dresser Industries, Inc., Dallas, Tex.

[21] Appl. No.: 41,660

[22] Filed: May 23, 1979

[51] Int. Cl.[3] ..... C21B 7/02

[52] U.S. Cl. ..... 266/286; 110/336; 110/339; 432/252

[58] Field of Search ..... 266/280, 281, 283, 286; 432/247, 252; 110/336, 339; 29/DIG. 8, DIG. 9

[56] References Cited

U.S. PATENT DOCUMENTS

| | | | |
|---|---|---|---|
| 1,040,422 | 10/1912 | Ruebel | 432/252 |
| 1,100,062 | 6/1914 | Faulds | 432/252 |
| 3,006,046 | 10/1961 | Shephard et al. | 266/286 |
| 3,449,084 | 6/1969 | Smoot et al. | 432/252 |
| 3,655,356 | 4/1972 | Javaux | 266/286 |
| 3,669,640 | 6/1972 | Brichard et al. | 266/286 |
| 3,829,960 | 8/1974 | Hubble et al. | 266/283 |
| 4,107,890 | 8/1978 | Seghezzi et al. | 110/336 |

*Primary Examiner*—R. Dean
*Assistant Examiner*—John P. Sheehan
*Attorney, Agent, or Firm*—Raymond T. Majesko

[57] ABSTRACT

Bottom blown metallurgical vessels using oxygen having a brick assembly which is secured together by metal anchors.

3 Claims, 2 Drawing Figures

BRICK ASSEMBLY FOR USE IN METALLURGICAL VESSELS

FIELD OF INVENTION

The invention relates to an oxygen converter for making steel, particularly to a brick assembly for use in a converter, in which oxygen is blown into the molten metal from below the vessel.

BACKGROUND OF THE INVENTION

Steel has been manufactured quite extensively in a vessel known as the basic oxygen furnace. In this furnace, pure oxygen is blown from above into the molten iron by a lance. This process is very economical for manufacturing certain types of steels but it has a number of disadvantages in comparison with a converter that has oxygen blown from below. It requires expensive lances that are subject to a great deal of wear from splashing iron and slag and from high temperatures in the area of the stream of oxygen contacting the surface of the bath. In addition, the mixing of the bath and the equalization of concentrations, with the oxygen blowing process, is not as intensive as with a bottom blown converter. Another disadvantage is that a good deal of the oxygen passes to the melt through the slag, the iron oxide content of which is correspondingly high.

In the basic oxygen furnace process, only some of the oxygen emitted by the lance is utilized. Some of the oxygen reacts with the waste gas of the refining reactions. These gases are hard to collect and must be subjected to costly cleaning treatment. Also, heat losses arise from vaporization of the iron in the region of the burning spot, which also causes brown smoke.

The use of oxygen in bottom blown converters for making steel is not new. Sir Henry Bessemer is recognized for suggesting its use in 1856, although it was not really practical before large scale oxygen plants were developed which was about 1928. The unusually rapid wear in the converter bottom in part, from the blowing in of pure oxygen, prevented this proposal from being very successful. One reason for this rapid wear was that the bottoms were made from monolithic material by casting mixtures of refractories and baking them to high temperatures in special ovens. These bottoms were the natural outgrowth of the converted Bessemer shops.

Bottom life in bottom blown converters has been improved by utilizing refractory brick shapes. The longtime performance of brick bottoms is better than that of monolithic bottoms because of the wide ranges of properties possible in brick production compared with the narrower range of properties possible in large monolithic bottoms. Brick can be formed under pressure, fired and impregnated if desired. Further, the in-plant facility having proper fume control that would be required to heat, mix, vibrate and bake monolithic bottoms, would not be needed when brick are used. Repair of the bottoms of these vessels is made easy by utilizing a flat removable bottom or plug, which is smaller than the furnace inner diameter and separated from the stationary bottom by a monolithic refractory joint to facilitate bottom removal. The removable bottom contains multiple spaced apertures for injecting the oxygen.

OBJECT OF THE INVENTION

It is among the objects of the invention to provide a means of improving the refractory bottom or plug life of an oxygen converter by stabilizing the refractory structure such that the last 2–3 inches of brickwork remaining on the plug can be consumed by normal wear elements rather than loss of structural integrity and subsequent floating out.

SUMMARY OF THE INVENTION

In accordance with the present invention, there is provided a brick assembly for use in metallurgical vessels. The assembly comprises two adjacent pairs of refractory shapes secured together by a metal anchor.

IN THE DRAWINGS

FIG. 1 is an elevation view partly in cross section of a typical oxygen converter bottom blown vessel including a removable bottom and construction according to the present invention; and FIG. 2 is an elevation view partly in cross section of a brick assembly according to the present invention.

DETAILED DESCRIPTION OF THE INVENTION

Figure 1:
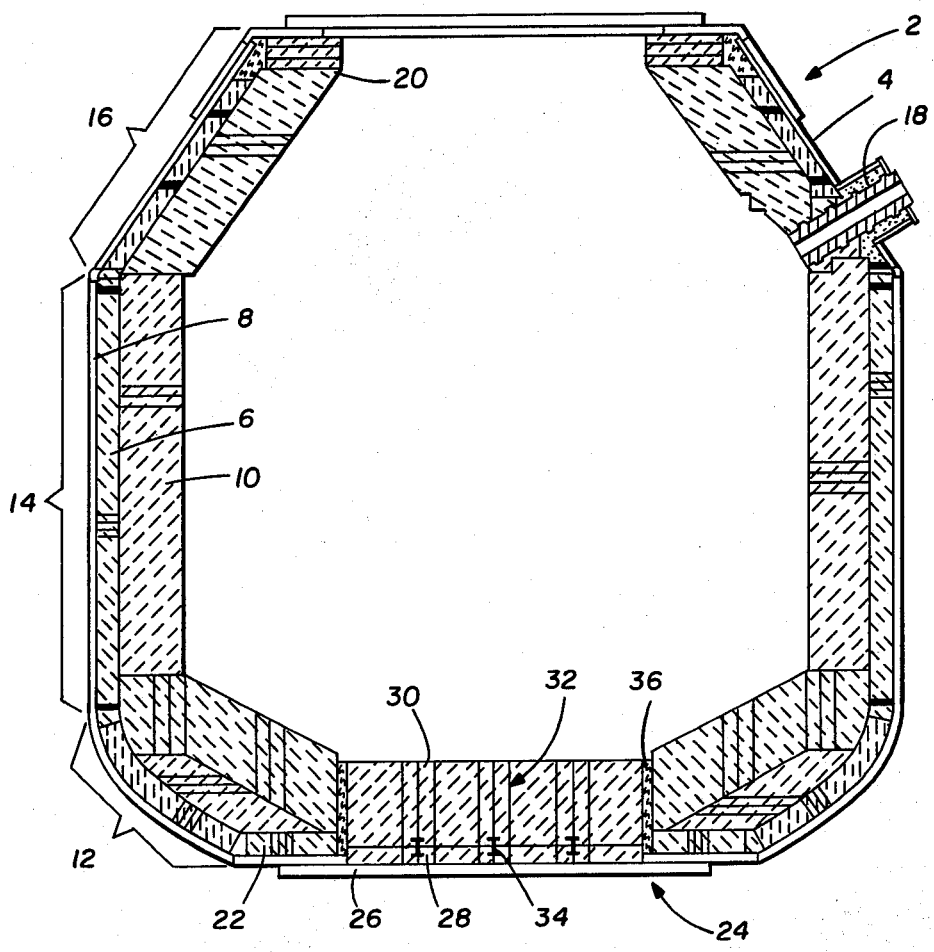

Referring to FIG. 1, there is indicated a bottom blown oxygen converter 2 comprising an outer metal shell 4, a shell protective or back-up brick lining 6 in contact with the inside surface of the shell 8, and a brick working lining 10. The vessel is constructed in three major zones including the bottom zone 12, the barrel zone 14 and the cone section zone 16. The bottom zone is of upwardly opening, dish-shaped or can be described as an inverted dome. The cone section zone having a taphole 18, extends upwardly and terminates in the form of a mouth 20 at the top of the vessel.

Figure 2:
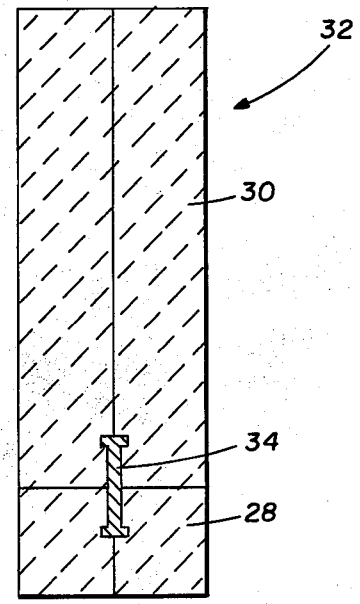

The bottom zone is divided into two sections, the stationary bottom 22 and the removable bottom 24. The present invention is directed particularly to the removable bottom section. The removable bottom 24 contains an outer metal plate 26, a safety lining 28 and a working lining 30 as does the rest of the vessel. At various locations throughout the bottom, quartets of brick 32 in the working and safety linings are secured together with metal anchors 34 as shown more clearly in FIG. 2. As can be seen, the metal anchors are I-shaped and are disposed between the four brick fitting in slots formed in the brick during manufacture. This prevents the working line from floating away from the safety lining. The removable bottom also contains through apertures (not shown) for injecting the oxygen. The removable bottom is secured to the stationary bottom with a monolithic refractory material 36 for easy removal when repair is necessary.

It is intended that the foregoing description and drawings be construed as illustrative and not in limitation of the invention.

The embodiments of the invention in which our exclusive property or privilege is claimed are defined as follows:

1. A metallurgical vessel for making steel having an outer metal shell, a refractory lining adjacent the shell and a removable relatively flat bottom section having an outer safety lining and an inner working lining composed of refractory brick, certain of said working lining brick being secured to certain of said safety lining brick with a metal anchor without contacting the metal shell.

2. Vessel of claim 1, in which the metal anchors are disposed between adjacent pairs of brick in the safety and working linings securing the pairs and the linings.

3. Vessel of claim 1, in which the metal anchor is I-shaped in cross-section.

* * * * *